US005355809A

United States Patent [19]

Dugge

[11] Patent Number: 5,355,809

[45] Date of Patent: Oct. 18, 1994

[54] GASKET FOR USE ON A RAILWAY HOPPER CAR OUTLET

[75] Inventor: Richard H. Dugge, St. Louis County, Mo.

[73] Assignee: ACF Industries Inc., Earth City, Mo.

[21] Appl. No.: 12,363

[22] Filed: Feb. 2, 1993

[51] Int. Cl.[5] ..... B61D 7/14

[52] U.S. Cl. ..... 105/424; 277/168; 277/169

[58] Field of Search ..... 105/282.2, 247, 424; 222/542, 570; 277/168, 169, 207 R; 285/910

[56] References Cited

U.S. PATENT DOCUMENTS

| | | | |
|---|---|---|---|
| 1,129,615 | 2/1915 | Sykes | 277/169 X |
| 2,789,844 | 4/1957 | Kessler | 277/169 X |
| 3,831,803 | 8/1974 | Hutchison et al. | 105/247 X |
| 4,155,561 | 5/1979 | Rudy et al. | 277/168 |
| 4,223,895 | 9/1980 | Roberts, Jr. et al. | 277/169 |
| 4,411,560 | 10/1983 | McComb | 406/145 X |
| 4,768,684 | 9/1988 | Dugge | 222/542 |
| 4,817,967 | 4/1989 | Belter | 277/207 R X |
| 4,884,723 | 12/1989 | Dugge | 222/542 |
| 4,975,000 | 12/1990 | Fritz et al. | 406/145 |
| 5,035,185 | 7/1991 | Schultz | 105/424 |

*Primary Examiner*—Robert J. Oberleitner
*Assistant Examiner*—S. Joseph Morano
*Attorney, Agent, or Firm*—Polster, Lieder, Woodruff & Lucchesi

[57] ABSTRACT

A railway hopper car (H) has a bottom outlet (B). An outlet assembly (A) is attached to the outlet for lading to be discharged into the outlet. An outlet flange (OF) at the bottom of the hopper defines the lading discharge outlet. A mating flange (F1) is formed on the outlet assembly for attaching the outlet assembly to the railcar. Fasteners (L) are used to mount the outlet assembly to the hopper bottom. A gasket (3) installed between the respective flanges effects a seal between the hopper outlet and outlet assembly. The gasket extends circumferentially about the opening. One of the flanges has a circumferential groove (9) and the gasket has a raised portion (15) extending circumferentially of the gasket and sized to be received in the groove. This arrangement aligns the gasket with the flanges so when the outlet assembly is mounted to the bottom of the hopper, no cavities are formed in the between the hopper outlet and the outlet assembly. Similarly, an end adapter (E1, E2) is attached to the ends of the outlet assembly. A second gasket (5) is used to effect a seal between the adapter and outlet assembly. A groove (23) is formed in an outlet assembly flange (F2) to which an end adapter flange (MF) mates, and the gasket has a raised portion (25) fitting in the groove also align the gasket.

8 Claims, 1 Drawing Sheet

GASKET FOR USE ON A RAILWAY HOPPER CAR OUTLET

BACKGROUND OF THE INVENTION

This invention relates to a gasket for railway hopper cars outlet and, more particularly, to an improved gasket for use with a pneumatic outlet for unloading particulate, granular, powdered, or fluent, solid ladings.

In U.S. Pat. No. 4,884,723, which is assigned to the same assignee as the present invention, there is disclosed a gasket for installation on a pneumatic outlet such as those installed on covered hopper railway cars. The advantage of such a gasket in helping prevent lading contamination is set forth in this patent, as well as in my co-assigned U.S. Pat. No. 4,768,684. Besides these gaskets, other gaskets such as the gasket disclosed in U.S. Pat. No. 5,035,185 are known in the art to achieve similar results. The gaskets shown in these patents are all used to form a seal between the bottom of a hopper car outlet, and the top of the outlet pan assembly. In addition to this surface, it is also important to effect a seal at each end of the outlet where an outlet adapter is installed for connection to the pneumatic equipment by which the lading discharging from the hopper into the outlet is entrained for delivery to a use site. The function of this second seal is the same as the first, i.e. prevention of lading contamination. One important element in the use of the various gaskets described in these patents is their alignment or orientation. During mounting of an outlet assembly to the bottom of a hopper, or mounting of end adapters to the sides of the outlet assembly, the gasket is manually fitted in place before the pieces are attached to each other. If the gasket is misaligned, gaps will result. Pellets or other particulate lading can then collect in these areas increasing the potential for contamination.

SUMMARY OF THE INVENTION

Among the several objects of the present invention may be noted the provision of a gasket for use on pneumatic outlets installed on covered hopper railway cars; the provision of such a gasket for preventing lading contamination; the provision of such a gasket which is usable in one form between the outlet pan assembly and bottom of the hopper car outlet, and in another form between the pan assembly and an outlet adapter mounted on the ends of the outlet assembly; the provision of such a gasket which effects a perfect alignment between the car and outlet, and outlet and end adapter; the provision of such a gasket having a flared inner end shape and a raised section or protrusion, and for one of the surfaces against which the gasket is placed to have retaining groove in which the protrusion fits thereby to effect the alignment; the provision of such a gasket which is usable as original equipment on a car or which can be retrofit on the car; the provision of such a gasket to be available in different sizes and shapes depending upon the type of car and outlet with which it is used; and, the provision of such a gasket to be low cost, and readily installed or replaced.

In accordance with the invention, generally stated, a railway hopper car has a bottom outlet. An outlet assembly is attached to the outlet for lading to be discharged from the hopper into the outlet. An improvement comprises an outlet flange formed at the bottom of the hopper and defining the outlet through which the lading discharges. A mating flange is formed on the outlet assembly for attaching the outlet assembly to the railcar. Fasteners are used for mounting the outlet assembly to the bottom of the hopper. A seal is installed between the respective flanges to effect a seal between the hopper outlet and the outlet assembly. The seal includes a gasket extending circumferentially about the opening. One of the respective flanges has a circumferential groove therein and the gasket has a raised portion extending circumferentially of the gasket and sized to be received in the groove. This configuration serves to align the gasket with respect to the flanges so when the outlet assembly is mounted to the bottom of the hopper, a seal is effected between the hopper outlet and the outlet assembly. Similarly, a second gasket is used to effect a seal between the outlet assembly and an end adapter attached to the outlet assembly. This second gasket also has a raised portion and a groove in one of the flanges at the interface has a groove in which the protrusion fits to align the gasket. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF PREFERRED EMBODIMENTS

Figure 1:
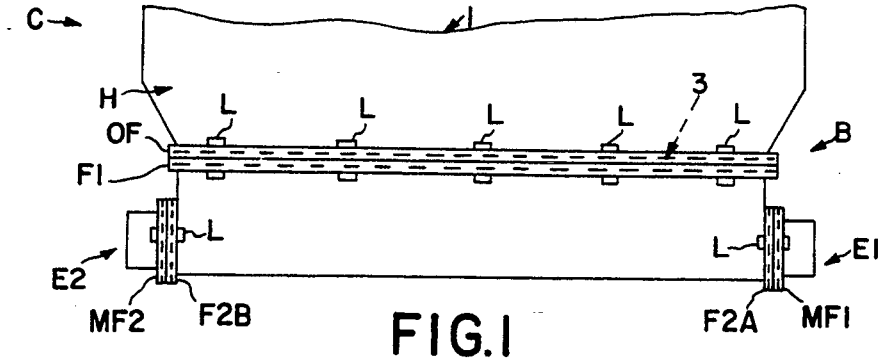
FIG. 1 is a representation of a covered hopper railway car with an attached outlet assembly, and with end adapters attached to the outlet assembly, and with sealing means of the present invention for preventing lading contamination.

Referring to the drawings, a railway car C, a portion of which is shown in FIG. 1, is a covered hopper railway car. Though only one hopper H of the car is shown in FIG. 1, it will be understood that the car has a series of longitudinally arranged hoppers in which a lading is transported. This lading may be, for example, a bulk particulate or powdered lading such as plastic pellets, cement, flour, etc. Each hopper has a bottom outlet B through which the lading is discharged. An outlet assembly A is attached outlet B for lading to be discharged from the hopper into the outlet assembly. In this regard, bottom outlet B has an outlet flange OF which defines an outlet O1 through which lading discharges into outlet assembly A. Typically, flange OF and the opening O1 it defines are rectangular in shape (See FIG. 2). Outlet assembly A has a first and mating flange F1 which is also rectangular in shape for attaching the outlet assembly to the railcar. The outlet assembly is bolted to the hopper bottom flange OF by fasteners such as bolts L.

Figure 5:
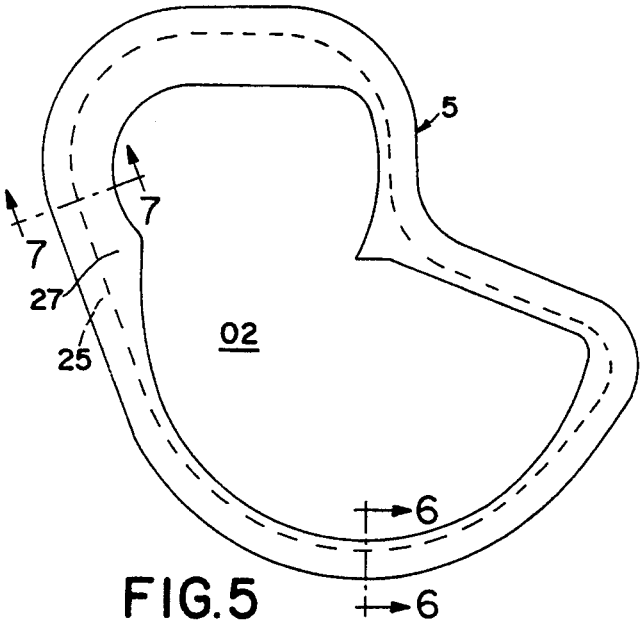
FIG. 5 is a plan view of a second gasket of the sealing means.

As further shown in FIG. 1, an end adapter E is attached to both ends of the outlet assembly; i.e., a first end adapter E1 is attached to one end of the outlet assembly, and a second adapter E2 to the other end. The end adapters are identical in construction. Lading discharge equipment (not shown) is connected to the outlet assembly, using the end adapters, to facilitate lading discharge. Each end adapter has a removable end cap (not shown). The outlet assembly has a second flange F2A or F2B formed at the respective ends of the outlet assembly. Each flange also defines an opening O2 through which the lading is discharged from the outlet assembly. As seen in FIG. 5, this second opening may be irregular in shape. Each end adapter has a mating flange MF1, MF2 for attaching the end adapter to the outlet assembly, this again being done with bolts L, for example.

Figure 2:
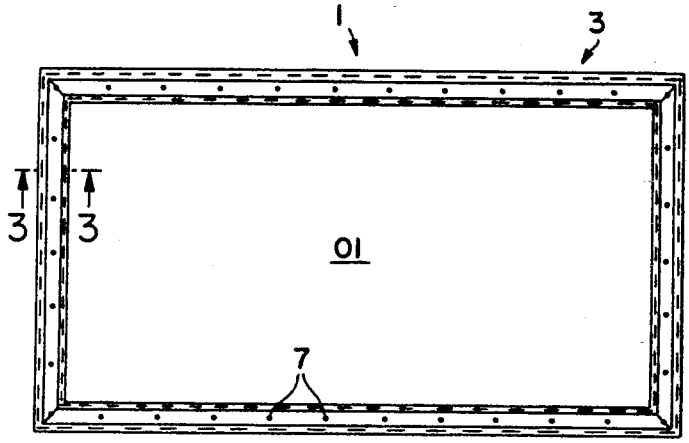
FIG. 2 is a plan view of a first gasket comprising a portion of the sealing means.
Figure 3:
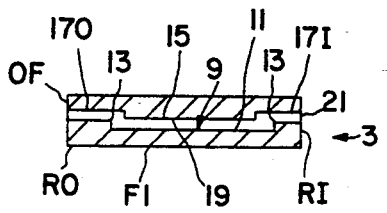
FIG. 3 is a sectional view of the gasket taken along line 3—3 in FIG. 2.
Figure 4:
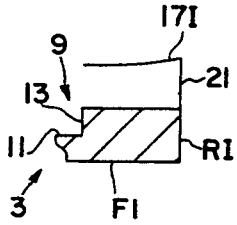
FIG. 4 is an enlarged view, taken from FIG. 3, of an inner end of the gasket.
Figure 6:
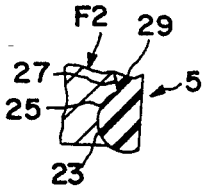
FIG. 6 is a first sectional view of the gasket taken along line 6—6 in FIG. 5; and, FIG. 7 is a second sectional view of the gasket taken along 7—7 in FIG. 5.
Figure 7:
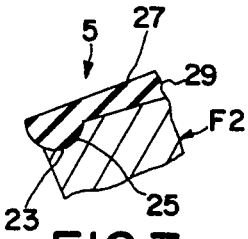

A sealing means indicated generally 1 in FIG. 1 is installed between the respective flanges OF and F1 to effect a seal between the hopper outlet and outlet assembly A. Sealing means 1 also is installed between the respective flanges F2A and MF1, and F2B and MF2 to effect a seal between the outlet assembly and the end adapters E1 and E2. Referring to FIGS. 2–4, sealing means 1 includes a first gasket 3 extending circumferentially about the opening O1 defined by bottom outlet flange OF and outlet assembly flange Fl. Referring to FIGS. 5–7, sealing means 1 further includes a second gasket 5 extending circumferentially about the opening O2 defined by the second outlet assembly flange F2 and the end adapter mating flange MF. As is described hereinafter, both of the outlet assembly flanges F1 and F2 have circumferential grooves formed therein. And, each gasket 3 and 5 has a raised portion extending circumferentially of the respective gasket and sized to be received in the respective grooves. This arrangement helps to align gasket 3 with the bottom outlet flange OF and outlet assembly flange F1, and gasket 5 with the end adapter flange MF and outlet assembly flange F2. The alignment, in turn, helps to effect respective seals between the various components to prevent lading from being trapped at the respective interfaces and contaminating subsequent ladings.

In FIG. 2, gasket 3, which like gasket 5, is made of a F.D.A. approved material, is seen to be rectangular in shape. The length and width of the gasket conform to that of outlet assembly flange F1. The gasket is formed with holes 7 spaced along its circumference for the shank of the fastening bolts L to be inserted through the gasket when the outlet assembly is bolted to the hopper bottom. Outlet assembly flange F1 is shown in section in FIG. 3. As seen therein, the flange has inner and outer circumferentially extending rims RI and RO respectively. The flange also has a central or intermediate groove 9 which also extends circumferentially of the flange. Groove 9 extends substantially the width of the flange and has a flat base 11 and sidewalls 13 extending perpendicular to the base. As also seen in FIG. 3, gasket 3 has a shape which conforms to that of flange F1. Accordingly, gasket 3 has a raised central section 15 which fits in groove 9, and inner and outer sections 17I and 17O which respectively overlay rims RI and RO. The width of raised section 15 of the gasket is slightly less than that of base 11 of the groove. Hopper bottom flange OF has protruberance 19 which fits in section 15 of the gasket when the outlet assembly is positioned against flange OF during installation of the outlet assembly. Prior to use of gasket 3, the gaskets used were essentially flat gaskets. The gasket was laid over the upper face of outlet assembly flange F1 during installation of the assembly to the railcar. If the gasket was misaligned, a gap might result. This gap or cavity then became a potential site where particles of lading became entrapped during offlaoding operations. As discussed, trapped particles could contaminate subsequent ladings. By providing a gasket 3 with a raised section 15, the gasket is readily aligned with outlet assembly flange F1 and hopper bottom flange OF. Since the gasket cannot be misaligned, no gaps will be formed which could trap particles.

Referring to FIG. 4, the inner end of the gasket, i.e., the end adjacent the opening, is shown to have a concave face 21, and this inner end of the gasket is outwardly flared. Such construction is similar to that described in my coassigned U.S. Pat. No. 4,884,723. During attachment of the outlet assembly to the hopper bottom, gasket 3 is compressed between the respective flanges. Gasket face 21 straightens as the gasket compresses to create a vertical face. This further helps prevent cavities from forming at the interface betwen the outlet assembly and the hopper.

Outlet O2 is shown in FIG. 5 to have an irregular shape. Accordingly, gasket 5 has a corresponding irregular shape. It will be understood that different model outlet assemblies may have different outlet shapes and that the end adapters used with the outlet assemblies will have correspondingly shaped openings. The gasket 5 used with these other outlet assemblies and end adapters will therefore match these opening shapes. The outer circumference of gasket 5 corresponds to that of the outlet assembly at its outer end.

The outlet assembly has a circumferential groove 23 formed at the outer edge of the outlet assembly flange F2. This groove is of a uniform width around the perimeter of the flange as shown in FIGS. 6 and 7. The raised portion of the second gasket comprises a rounded bead 25 formed on the outer perimeter of gasket 5 and extending around the circumference of the gasket. As with gasket 3, the provision of a groove in the outlet assembly flange, and the provision of a bead in the gasket, aligns the gasket to the flange when the gasket is installed. Such alignment insures there are no gaps created between the outlet assembly and end adapter when the end adapter is in place.

When fitted in place with bead 25 seated in groove 23, the outer surface of gasket 5 is flat. Further, inwardly of bead 25, gasket 5 has sealing surface 27. The width of this surface varies in accordance with the shape of outlet O2 about the circumference of the opening. Thus, as shown in FIG. 6, the width of sealing surface 27 is relatively narrow; while, as shown in FIG. 7, at a different location, the width is relatively wide. As with gasket 3, inner end 29 of gasket 5 is outwardly flared to form a concave inner face which becomes generally flat when an end adapter is mounted to the outlet assembly. Again, this prevents lading from being trapped at the respective mating surfaces.

What has been described is an gasket for use on pneumatic outlets installed on covered hopper railway cars to provide an efffective seal against lading contamination. In one form, the gasket is uasble in one form between the outlet pan assembly and bottom of the hopper car outlet. In another form, the gasket is usable between the pan assembly and an outlet adapter attached to an end of the assembly. The gasket effects a perfect alignment between between the car and outlet, and the outlet and end adapter. To accomplish this, the gasket has a flaring outer end and a raised portion, or protrusion, on one side. One of the flanged surfaces against which the gasket is placed has retaining groove in which the protrusion fits to help produce the alignment. The gasket is usable both as original equipment on a car, and as a retrofit item. The gasket is readily installed during manufacture or servicing of the car, and the gasket is available in different sizes and shapes for use with different type of cars and outlets.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. In a railway hopper car having a bottom outlet to which an outlet assembly is attached for lading to be discharged from the hopper into the outlet assembly, and an end adapter attached to at least one outer end of the outlet assembly for lading discharge equipment to be connected to the outlet assembly, the improvement comprising:

a flange formed at the end of the outlet assembly and defining an opening through which the lading is discharged from the outlet assembly;

a mating flange formed on the end adapter for attaching the end adapter to the outlet assembly;

fastening means for mounting the end adapter to the outlet assembly; and, sealing means installed between the respective flanges to effect a seal between the end adapter and the outlet assembly, the sealing means including a gasket extending circumferentially about the opening, one of the respective flanges having a circumferential groove therein, and the gasket having a raised portion extending circumferentially of the gasket and sized to be received in the groove to align the gasket with respect to the flanges so when the end adapter is mounted to the outlet assembly, a seal is effected therebetween to prevent lading from being trapped and contaminating subsequent ladings, and said groove being formed on the outlet assembly flange wherein the outlet has an irregular shape and the gasket has a corresponding irregular shape, and the groove is formed at the outer edge of the outlet assembly flange and is of a uniform width around the perimeter of the flange.

2. The improvement of claim 1 wherein the raised portion of the gasket comprises a bead formed on the outer perimeter of the gasket and extending circumferentially therearound.

3. The improvement of claim 2 wherein the inner end of the gasket is outwardly flared so to become generally flat when the end adapter is mounted in place by tightening the fasteners, the resulting flat surface preventing lading from being trapped at the mating surface between the end adapter and outlet assembly.

4. The improvement of claim 1 wherein the gasket is formed of a F.D.A. approved material.

5. In a railway hopper car having a bottom outlet to which an outlet assembly is attached for lading to be discharged from a hopper into the outlet assembly, and an end adapter attached to at least one outer end of the outlet assembly for lading discharge equipment to be connected to the outlet assembly to facilitate lading discharge, the bottom outlet having an outlet flange defining the outlet through which lading discharges into the outlet assembly, the outlet assembly having a first and mating flange for attaching the outlet assembly to the railcar, the outlet assembly further having a second flange formed at an end of the outlet assembly and defining an opening through which the lading is discharged from the outlet assembly, and the end adapter having a mating flange formed thereon for attaching the end adapter to the outlet assembly, the improvement comprising;

sealing means installed between the respective flanges to effect a seal between the hopper outlet and the outlet assembly and between the outlet assembly and the end adapter, the sealing means including a first gasket extending circumferentially about the opening defined by the bottom outlet flange, and a second gasket extending circumferentially about the opening defined by the second outlet assembly flange, both of the outlet assembly flanges having circumferential grooves therein and each of said first and second gaskets having a raised portion extending circumferentially of the respective gasket and sized to be received in the respective grooves to respectively align said first gasket with the bottom outlet flange and first outlet assembly flange, and said second gasket with the end adapter flange and the second outlet assembly flange, thereby to effect respective seals therebetween to prevent lading from being trapped and contaminating subsequent ladings, the groove formed in said first outlet assembly flange being formed intermediate inner and outer ends of the flange and the first gasket has an inner section, a middle section, and an outer section, the middle section of the gasket comprising the raised portion thereof, the outlet defined by said second outlet assembly flange having an irregular shape and said second gasket having a corresponding irregular shape with the groove formed at the outer edge of said outlet assembly second flange being of a uniform width around the perimeter of said second flange.

6. The improvement of claim 5 wherein the raised portion of said second gasket comprises a bead formed on the outer perimeter of said second gasket and extending circumferentially therearound.

7. The improvement of claim 6 wherein the inner end of each of said first and second gaskets is outwardly flared so to become generally flat when the outlet assembly is mounted to the bottom outlet and the end adapter is mounted to the outlet assembly, the resulting flat surface at the inner end of each said gasket preventing lading from being trapped at the respective mating surfaces.

8. The improvement of claim 5 wherein each gasket is formed of a F.D.A. approved material.

* * * * *